United States Patent [19]

Valavaara

[11] Patent Number: 5,066,207

[45] Date of Patent: Nov. 19, 1991

[54] ROTARY DEVICE

[76] Inventor: William K. Valavaara, R.R. #1, Chesley, Ontario, Canada

[21] Appl. No.: 520,796

[22] Filed: May 8, 1990

[51] Int. Cl.[5] ..... F04C 2/063

[52] U.S. Cl. ..... 418/171

[58] Field of Search ..... 418/171, 166, 167, 168

[56] References Cited

U.S. PATENT DOCUMENTS 1,277,436 9/1918 Lind ..... 418/167
2,634,582 4/1953 Klatte et al. ..... 418/171

FOREIGN PATENT DOCUMENTS 96525 11/1922 Switzerland ..... 418/171
738296 10/1955 United Kingdom ..... 418/168

OTHER PUBLICATIONS

Rotary Piston Machines—Author: Felix Wankel, Published by London Iliffe Books Limited.

*Primary Examiner*—Richard A. Bertsch
*Assistant Examiner*—David L. Cavanaugh

[57] ABSTRACT

A rotary device having an outer rotor having bearings on a first axis, an inner rotor mounted within the outer rotor having bearings on a second axis of rotation offset from the first axis, and in which both outer and inner rotors rotate together in unison and define a spacing between the rotors varying from a minimum to a maximum at respective positions on opposite sides of the rotors, an enclosure at least partially enclosing the rotors, defining an inlet port and an outlet port, an outer annular wall and a plurality of semi-cylindrical contact bodies on the outer rotor, and a like plurality of recesses of semi-cylindrical shape in section in the inner rotor, and there being partitions between the recesses, with head portions on the partitions having a radiussed outward surface, and two acute angle corners, one at each end of the head portion, respective recesses receiving respective abutments so that, upon rotation, any one body may move inwardly and outwardly of its respective recess as the spacing between the rotors varies and brush around its respective recess and the radiussed surfaces of the head portions contacting the outer annular wall at the point of minimum spacing.

5 Claims, 4 Drawing Sheets

ROTARY DEVICE

FIELD OF THE INVENTION

The invention relates to a positive displacement rotary device, such as a motor or pump, for use generally with fluids, and in particular with liquids.

BACKGROUND OF THE INVENTION

Rotary devices for use as pumps or motors usually suffer from certain basic design limitations, namely that they operate with maximum mechanical efficiency only over a relatively narrow range. That is to say, the output of a device is at a maximum over a relatively narrow range of rotational speeds. Above such range, the output of the device will drop significantly. Numerous proposals have been made to produce such rotary devices having a wider efficient working range, the usual idea behind such attempts being to employ a rotary type device, which provides positive displacement of the fluid material. However, the majority of positive displacement rotary devices suffer from other disadvantages. Some of them are excessively complex, resulting in great expense and high frequency of repair. Others suffer from problems of sealing working surfaces, and in others considerable wear is caused by friction. Still others suffer from difficulties in attempting to balance eccentric forces. Valving and porting of such devices is also a common problem.

In rotary devices of the gear type a common problem is the trapping and pressurization of liquid between the gears, resulting in noisy operation and low mechanical efficiency, particularly at high rotative speeds. Existing methods to solve this problem in gear-type devices are complex and expensive.

In internal gear-type rotary devices (commonly known as "gerotors"), there is an inner and an outer rotor. Teeth on the internal surface of the outer rotor are adapted to mesh with teeth on the inner rotor. Adjacent teeth on the same rotor define recesses therebetween. In known gerotors, there is usually one tooth more on the outer rotor than on the inner rotor. Both rotors rotate. However, because of the different number of teeth on each rotor, one rotor rotates faster than the other, and thus there is relative rotation between the two rotors. Each tooth translates from one recess into another adjacent recess on the other rotor. Fluid may be trapped between a tooth and the bottom of a recess.

It will of course be readily appreciated that the advantages obtained by providing an efficient rotary device using a positive displacement principle are very great. Thus, for example, such a device can theoretically be used both for the relatively low pressure, high flow rate applications, and may, with various engineering changes, be used for the pumping of liquids at high shaft speeds.

As mentioned, numerous attempts have been made to design rotary devices to take advantage of such wide-ranging applications. Some of such attempts have depended on a central rotor with movable vanes rotating in a chamber. Others have employed two rotors rotating in opposite directions with interlocking vanes. Still others have attempted to solve the problems by using eccentrically-shaped rotors rotating in a specially shaped chamber. However, all of these proposals suffer from one or other of the disadvantages noted above.

Other devices, although effective, are costly to machine and require maintenance of precise tolerances.

BRIEF SUMMARY OF THE INVENTION

The present invention seeks to overcome the foregoing disadvantages by the provision of a rotary device comprising a rotatable outer rotor defining a first axis of rotation, an internal cavity and axial ends, outer rotor bearing means whereby same may rotate on said first axis, a rotatable inner rotor mounted within said cavity for simultaneous co-rotation with the outer rotor in the same direction, inner rotor bearing means for said inner rotor defining a second axis of rotation, being offset with respect to said first axis whereby to define a spacing between said rotors varying from a minimum to a maximum at respective positions on opposite sides of said rotors, a transverse axis between said positions defining an inlet side of said rotors on one side of said axis and an outlet side of said rotors on the other side of said axis, wall means at least partially enclosing said rotors, said wall means defining inlet port means on said inlet side of said transverse axis and outlet port means on said outlet side of said transverse axis, a first sealing wall portion thereof being located around said position of minimum spacing and a second sealing wall portion thereof being located around said position of maximum spacing, an outer annular wall on said outer rotor, a plurality of abutments with semi-cylindrical shaped contact bodies on said outer wall, a like plurality of recesses of semi-cylindrical shape in section on said inner rotor, and there being partitions between the recesses, with head portions on the partitions having a radiussed outward surface, and two acute angle corners, one at each end of each head portion, respective recesses receiving respective abutments therein, whereby upon rotation of said rotors in unison any one abutment may move orbitally within its respective recess as said spacing between said rotors varies, with respective said contact bodies brushing around respective said recesses, and the radiussed surfaces of the head portions contacting the outer annular wall at the point of minimum spacing.

A significant feature of the invention is the fact that because both the rotors co-rotate together in unison, but on different rotational axes, the only relative motion between the rotors is the orbital sweeping action of a contact body about its recess. Consequently, there is little or no rubbing friction of the type requiring complex lubrication. With proper choice of materials for the rotary device according to the invention, the working liquid may itself provide all necessary lubrication. Contact between the abutments and the surfaces of the recesses can be minimized so as to reduce lubrication requirements. Rubbing movement between rotors may be further reduced by the use of synchronizing gears linking both rotors for rotation simultaneously. In addition, since both rotors operate on axes which are central of themselves, although the two axes are spaced apart from one another, there are no orbital or eccentric centrifugal forces which are difficult to balance out. In addition, there are only two moving parts, namely the two rotors, consequently manufacture and assembly are simplified to a degree not found in almost any other such rotary device.

The partitions and heads on the inner rotor, between the recesses, provide momentary brushing contact with the annular wall of the outer rotor at the point of minimum spacing to maintain an effective seal at this point in the rotational cycle of the device.

The size of the rotary device according to the invention is smaller than standard rotary devices capable of similar mass flow rates, allowing for savings in material, weight and cost. Conversely, for devices of the same size, a device according to the invention will have a greater output.

More particularly, it is an objective of the invention to provide a rotary device of the type described wherein the outer rotor of the device has an internal cavity with a radius R1, the inner rotor has a radius R2, and wherein the dimensions of the recesses, the bodies, and the arms are established in the following range:

Recess Radius (Rr)=between about 0.2R1 and 0.25R1

Body Radius (Br)=between about 0.1R1 and 0.2R1

Arm thickness (t)=between about 0.06R1 and 0.25R1 and wherein the eccentricity (e) equals 0.5(R-I) Br).

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Referring to FIGS. 1 to 4, the illustrated embodiment of the invention will be seen to comprise a rear housing plate 10 and a front housing plate 12, which are shown schematically, and merely represent any form of supporting structure which may or may not be a complete housing, which act as supports.

Figure 2:
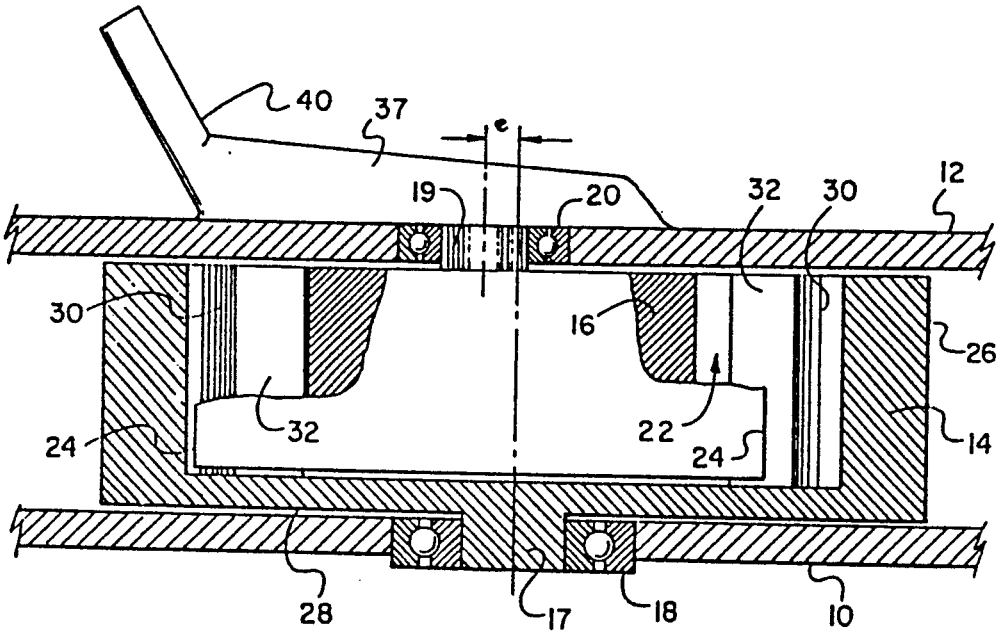
FIG. 2 is a section along line 2—2 of FIG. 1.
Figure 3:
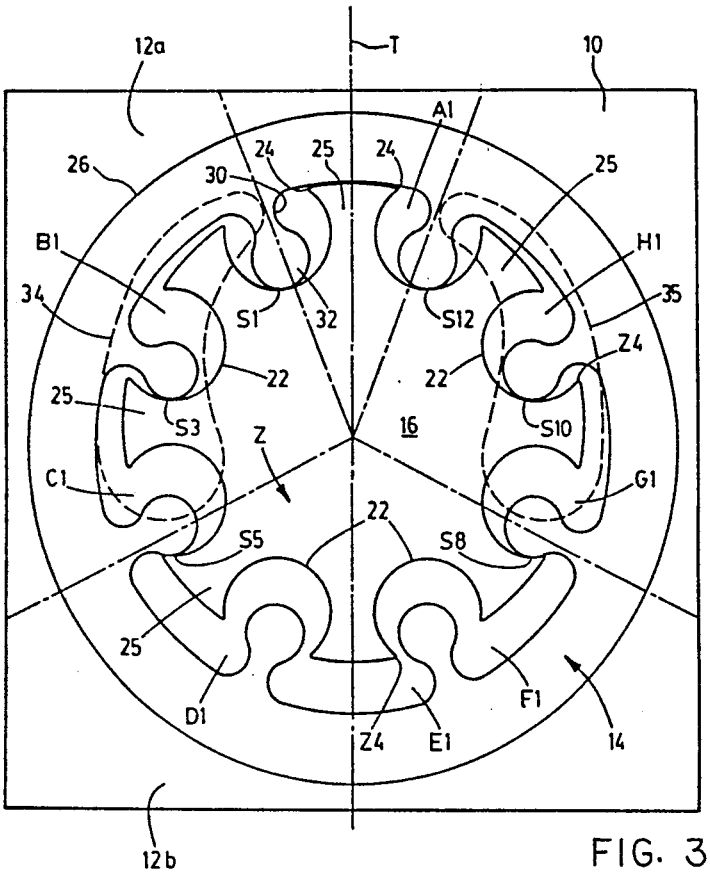
FIG. 3 is a schematic plan view of a rotary device according to the invention.

The outer rotor 14 is rotatably mounted on rear housing plate 10 and the inner rotor 16 is rotatably mounted on the front plate 12. The outer rotor 14 is suitably rotatably mounted by means of a boss 17 turning in a bearing 18, on rear mounting plate 10. Inner rotor 16 is rotatably mounted by means of integral boss 19, and a bearing 20 mounted in front plate 12. As best shown in FIGS. 2 and 3 the axes of rotation of rotors 14 and 16 are offset with respect to one another.

Both rotors 14 and 16 are circular in plan, and are symmetrical about their respective centres, thereby greatly simplifying manufacture and balancing of the devices during use.

Inner rotor 16 is provided with a plurality of recesses 22 which comprise a generally semi-cylindrical shape in cross-section and extend from side to side of rotor 16. Each of recesses 22 communicate with the interior of outer rotor 14 by means of an opening 24. Between adjacent recesses 22, inner rotor 16 defines partition members 25.

Recesses 22 define a semi-cylindrical arc greater than 180 degrees.

The partition members 25 extend outwardly from inner rotor 16 and terminate in free outer ends, 25*a* having outwardly directed arcuate surfaces 25*b* of predetermined radius r, and having at each end an acute angle tip 25*c*.

Outer rotor 14 comprises a cylindrical or annular outer wall 26, and a circular flat rear wall 28, walls 26 and 28 thereby defining a generally circular open interior cavity, within which inner rotor 16 is located.

Any means such as the boss 17 and bearing 18 may be provided for rotatably supporting outer rotor 14 for rotation about a symmetrical axis as described above.

It will, of course, be appreciated that the illustration of boss 17 and bearing 18, is purely schematic. Rotor 14 could equally well be mounted for rotation in a suitable bearing sleeve for example, (not shown), supported in any suitable way. In addition wall 28 could be formed separately.

Within the interior of outer rotor 14, a plurality of integral abutment members 30 are provided, rooted on the inner surface of wall 26 and extending inwardly in a radial manner.

Abutment arm members 30 terminate in contact bodies 32 of semi-cylindrical shape for purposes to be described. Contact bodies 32 are cylindrical in profile around an arc of at least 270 degrees, and abutment arm members 30 define narrow necks or stems joining the contact bodies 32 to the perimeter wall 26 of the outer rotor 14.

Between abutment members 30, wall 26 defines arcuate wall surfaces 26*a*, of a predetermined radius of curvature R, greater than radius r of ends 25*a*.

Located in the front housing plate 12, there are an inlet opening 34 and an outlet opening 35. The openings 34 and 35 are generally arcuately shaped or "kidney" shaped. The designation of ports 34 and 35 as inlet and outlet is purely by way of explanation, and without limitation.

Respective port covers 37 cover the two ports, and the covers 37, in turn, are provided with pipes 40, by means of which the device may be connected in a hydraulic circuit.

Boss 19 and bearing 20 of inner rotor 16 are on an axis which is displaced or offset by a predetermined distance "e" from the axis of boss 17 and bearing 18 of outer rotor 14.

Because the axes of rotors 14 and 16 are offset, a spacing is defined between the rotors which varies from a minimum to a maximum of respective positions on opposite sides of the inner rotor. In the illustrated embodiments, the minimum spacing position is at the twelve o'clock position. The maximum spacing position is at the six o'clock position. Such positions of minimum and maximum spacing define a notional dividing line. Such line defines and separates an inlet side of the rotary device on one side of the line and an outlet side of the rotary device on the other side.

The rotary device, in general terms, can be used either as a pumping device or as a motor, as such devices are generally known in the trade.

For the purposes of this discussion, it will be assumed that the rotary device illustrated is being used as an hydraulic motor, that is to say, a device into which hydraulic fluid is pumped under pressure, and which is then used to convert the flow of such hydraulic fluid into rotary movement.

Figure 1:
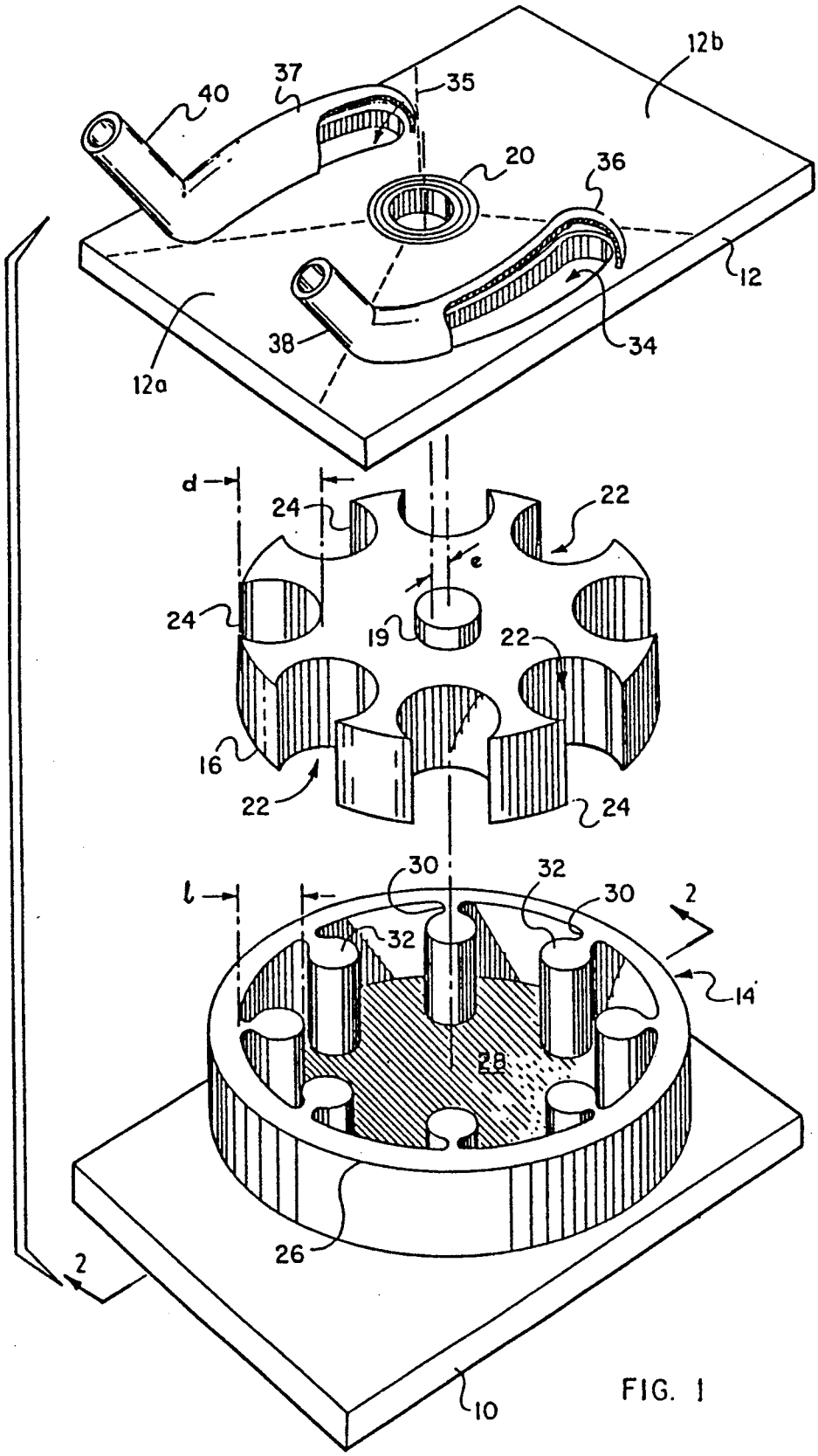
FIG. 1 is an exploded perspective illustration of a rotary device according to the invention.

Front support wall 12 defines a sector-shaped upper wall portion 12*a* centered at the twelve o'clock position of FIG. 1 between ports 34 and 35. Support wall 12 also defines a sector-shaped lower wall portion 12*b* centered at the six o'clock position of FIG. 1 between ports 34 and 35.

Ports 34 and 35 are of such length as to register with a plurality of recesses 22 simultaneously. In the configuration illustrated, such ports register with a maximum of three recesses 22 simultaneously.

Figure 4:
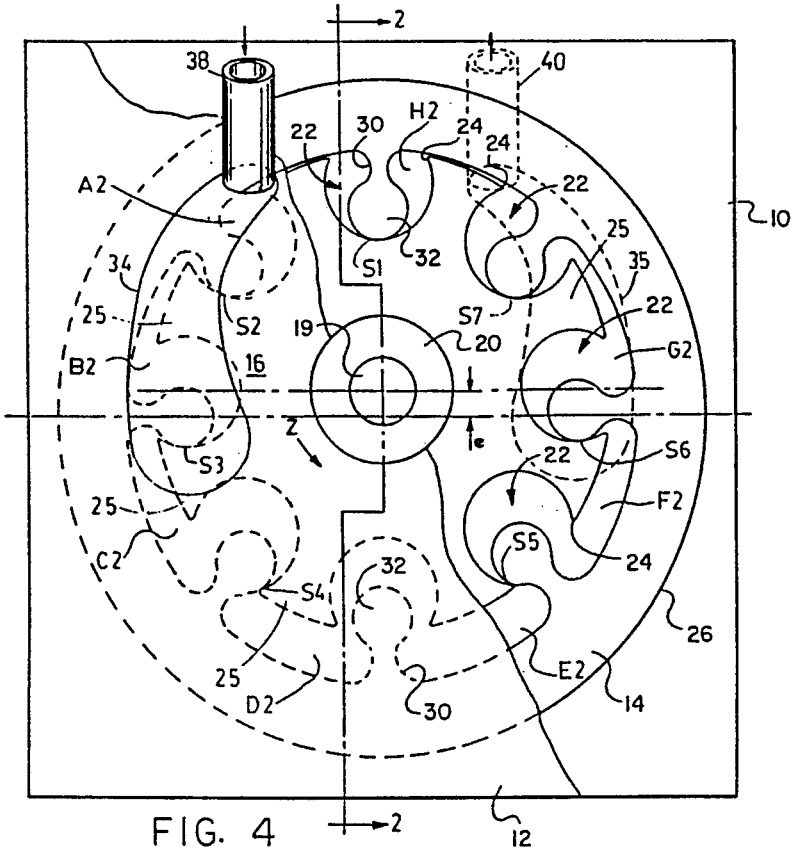
FIG. 4 is a schematic plan view of the device of FIG. 3 in a different angular position.
Figure 6:
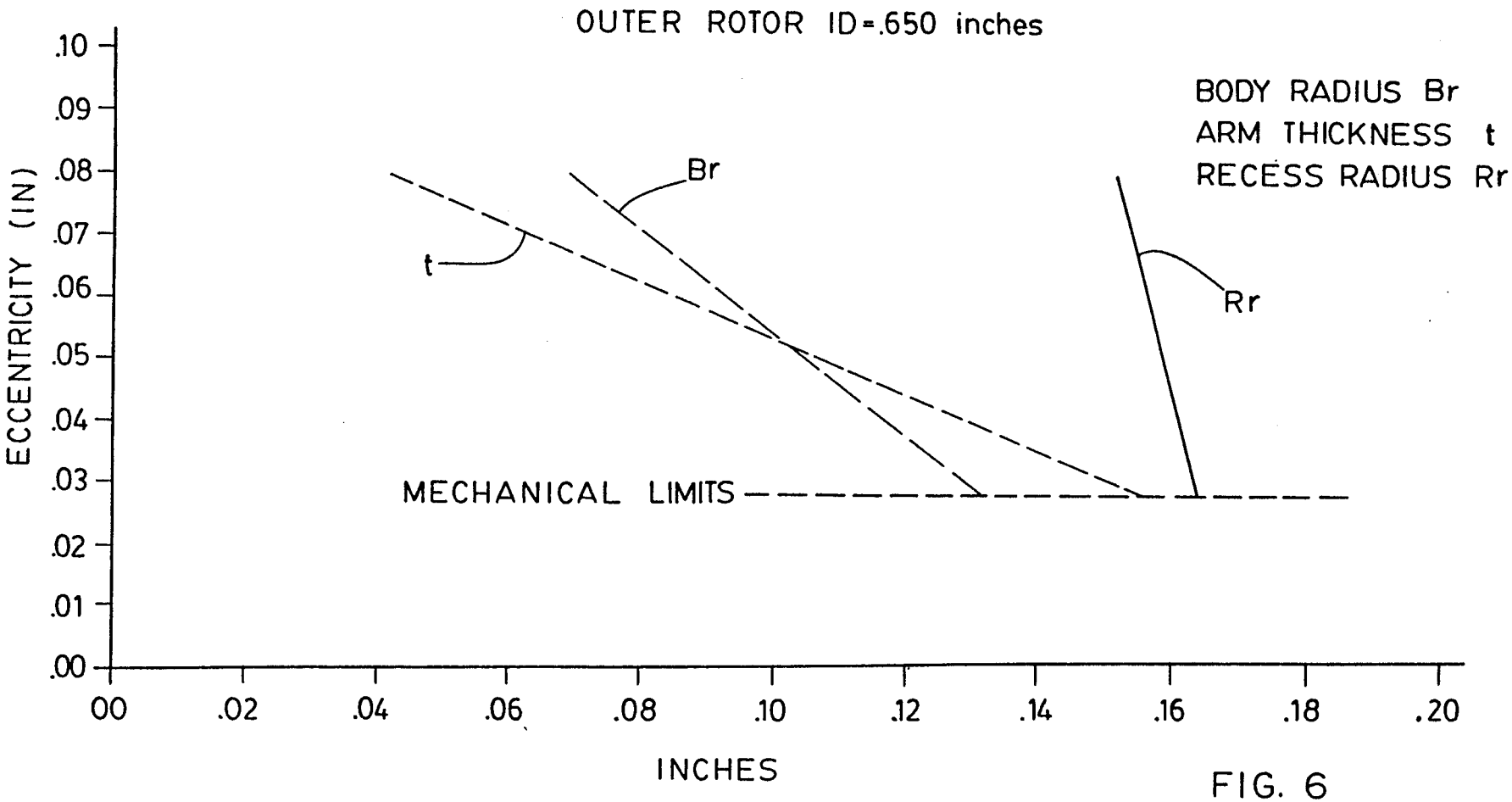

As best shown in FIGS. 3 and 4, this embodiment of the invention provides recesses 22 and bodies 32, which are of predetermined complementary semi cylindrical shapes so as to effectively provide wiping seals around the rotors as generally indicated at S1 to S7. On either side of bottom dead center the seals are momentarily broken. It will be understood that FIGS. 3 and 4 illustrate the device in two different rotational positions. Thus, FIG. 4 is rotated relative to FIG. 3 an arcuate distance equal to one-half the angular extent or length of a recess 22.

For the purposes of this discussion, the spacing between a recess 22 of the inner rotor 16 and the wall 26 of outer rotor 14, forms a chamber of the device.

For the purposes of this discussion, such chambers are shown in FIG. 3 as A1 B1 C1 D1 E1 F1 and G1 respectively, and in FIG. 4 as A2 B2 C2 D2 E2 F2 and G2 respectively.

The inlet port 34 is located so that it extends approximately from the eleven o'clock to the eight o'clock position; and outlet port 35 extends approximately from the four o'clock to the one o'clock position. The precise extent of such ports will depend upon the engineering of the particular rotary device.

In order to ensure that there is a separation between the two ports, inlet and outlet ports 34 and 35 are angularly spaced apart about the twelve o'clock position by an amount at least corresponding to the maximum angular width between two abutments 30, when one recess is centered at the twelve o'clock position (see FIG. 3). Upper wall portion 12*a* separates one port from the other, within this angular space.

In order to separate the high pressure side from the low pressure side at bottom dead center, inlet and outlet ports 34 and 35 are angularly spaced apart about the six o'clock position by an amount at least corresponding to the maximum angular extent of three recesses when one recess is centered at the six o'clock position.

Such spacing of the inlet and outer ports 34 and 35 ensures that there will always be a seal between such ports and thus high pressure fluid cannot flow directly from one side to the other.

The bodies 32 and recesses 22 from about four o'clock clockwise to about eight o'clock are so arranged and dimensioned that the bodies 32 slide around the semi-cylindrical surfaces of their associated recesses so as to effectively seal the same, so that a significant amount of fluid may not pass around from one chamber to another.

As shown in FIG. 3, between eight o'clock and four o'clock, the seal transfers from one side of a recess and its body 32, to the other. Between such positions there may be passage of fluid from one chamber to another at, or close to, the six o'clock position (FIG. 3).

Where the device is used as a hydraulic motor, then pressurized hydraulic fluid is supplied to the inlet port 34, and this will then fill the chambers registering with the inlet port at that moment.

This will procure rotation of both outer and inner rotors in an anti-clockwise direction, and as each chamber progressively increases in size, while registering with the inlet port, more and more hydraulic fluid will fill each of the chambers.

As each of the chambers passes out of communication with the inlet port, other chambers will be in registration with the inlet port, and so rotation will continue.

Since the volume of the chambers continues to increase until the six o'clock position, the effect of the pressurized fluid within the chambers will be to continue to procure rotation.

As the chambers pass the six o'clock position, their volume reduces and they will commence registering with the outlet port 35. The hydraulic fluid will thus be ejected, having given up its pressure, to cause rotation of the device.

When the device is being used as a pump, rotary power is supplied to one or other of the two rotors.

It may be desirable to have a gear system between the two rotors (not shown) in order to maintain precise accurate angular spacing between them, although in practice this has not been found to be necessary.

In the case of a pump, a low pressure fluid is supplied to the inlet port, and the chambers will progressively fill as before. As the rotation continues as a result of a rotary force from some other motor (not shown), applied to the outer rotor, hydraulic fluid will be transferred to the outlet port, and will be progressively ejected, thereby providing a continuous rotary pumping action.

In the foregoing description, no reference has been made to sealing means around the rotors, which clearly will be incorporated in accordance with well-known practice in the art, for preventing escape of fluids, as and where needed, the details of which are omitted for the sake of clarity. Typically, however, such sealing means will extend between the cylindrical wall and abutments of the outer rotor and the front plate, and between the main body of inner rotor and the rear wall the of outer rotor, and also between the main body of inner rotor and the front plate.

Figure 5:
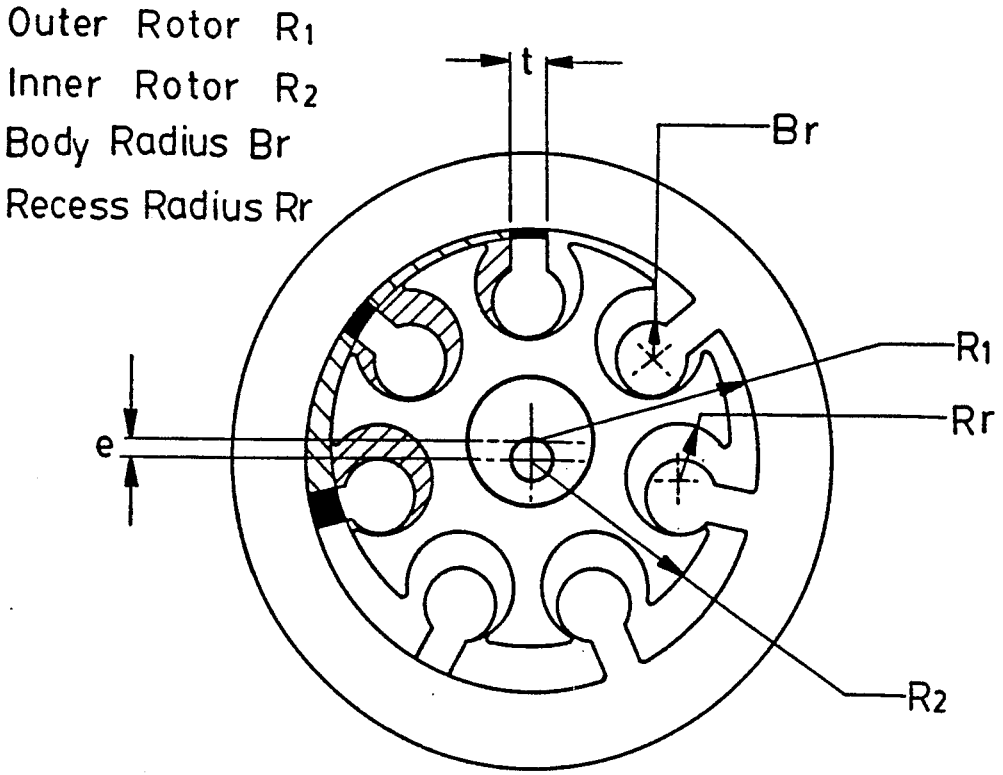
FIG. 5 is an illustration of the rotary device in another position showing relative dimensions; and, FIG. 6 is a graphic illustration showing the range of variation of the dimensions of the components, for a given outer rotor radius.

In order to function effectively as a pump or motor for fluids, such as hydraulic fluids, water, and the like, the rotary device, in accordance with the invention, should conform to a range of dimensional relationships for a given radius. The radius of the device is defined herein as the radius of the internal cavity of the outer rotor shown in FIG. 5 as radius R1, and the inner rotor has a radius R2 and wherein the dimensions of the cavities, the bodies, and the arms are established in the following range.

Recess Radius (Rr)=between about 0.2R1 and 0.25R1

Body Radius (Br)=between about 0.1R1 and 0.2R1

Arm thickness (t)=between about 0.06R1 and 0.25R1 and wherein the eccentricity (e) equals 0.5(R-1) Br).

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A rotary device comprising:

an outer rotor defining a first axis of rotation, and bearing means therefor whereby same may rotate and having an annular outer wall, defining an internal cavity;

an inner rotor mounted within said cavity and bearing means therefor whereby same may rotate in the same direction as said outer rotor, said inner rotor defining a second axis of rotation, said second axis being offset with respect to said first axis whereby to define a spacing between said rotors varying from a minimum to a maximum at respective positions on opposite sides of said inner rotor, said positions defining a transverse axis between said positions, said axis defining an inlet side of said rotors on one side of said axis and an outlet side of said rotors on the other side of said axis;

wall means at least partly enclosing said rotors, said enclosure means defining inlet port means on said inlet side and outlet port means on said outlet side whereby fluid is prevented from entering or exiting said cavity except through said port means, said wall means including a larger wall portion located around said point of maximum spacing between said inlet port means and said outlet port means, and a smaller wall portion located around said position of minimum spacing between said outlet port means and said inlet port means;

a pre-determined number of contact bodies on said outer rotor of semi-cylindrical cross-sectional shape each said body defining a cylindrical arc of at least 270 degrees, in profile;

an abutment arm member extending between each said contact body, and said cylindrical wall of said outer rotor, each said abutment member defining a narrow neck extending between its respective contact body and said outer rotor, said outer wall between said abutments defining arcuate inwardly directed wall surfaces having a predetermined first radius;

a predetermined number of recesses in said inner rotor equal to said number of contact bodies of semi-cylindrical cross-sectional shape each said recess defining a semi-cylindrical arc greater than 180 degrees and receiving respective contact bodies, each said contact body forming a wiping seal with the cylindrical surface of its respective said recess over certain pre-determined angular regions during rotation;

partition members on said inner rotor extending radially outwardly between said recesses, having free ends defining outwardly directed arcuate surfaces of a predetermined second radius less than said first radius, and, wherein upon rotation of the two rotors together in unison any one contact body may move inwardly and outwardly within its respective recess as said spacing between said rotors varies and will slide around the cylindrical surface of said recess thereby effecting a seal between said recess and said contact body which seal is maintained over an angular region within said first enclosure portion, and at least one seal is maintained between a said contact body and said outer wall over a lesser angular region within said first enclosure portion.

2. A rotary device as claimed in claim 1 wherein said bodies are formed integrally with said outer rotor at equally spaced apart intervals therearound.

3. A rotary device as claimed in claim 1 wherein said contact bodies define a pre-determined diameter and said recesses define a diameter greater than the diameter of said contact bodies.

4. A rotary device as claimed in claim 1 wherein said wall means includes a front wall and said front wall defines said inlet and outlet port means, said inlet and outlet port means being of generally semi-arcuate shape and extending about an arc encompassing at least two said recesses.

5. A rotary device as claimed in claim 1 wherein said outer rotor cavity has a radius R1, and said inner rotor has a radius R2, and wherein the recesses, bodies, and arms are established in the following ranges:

Recess Radius (Rr)=between about 0.2R1 and 0.25R1

Body Radius (Br)=between about 0.1R1 and 0.2R1

Arm thickness (t)=between about 0.06R1 and 0.2R1 and wherein the eccentricity (e) equals 0.5(R1-I).

* * * * *